US007305805B2

(12) United States Patent
Dierl et al.

(10) Patent No.: US 7,305,805 B2
(45) Date of Patent: Dec. 11, 2007

(54) METHOD FOR MAKING A FLEXIBLE RECLOSABLE PACKAGE

(75) Inventors: Martin Bernhard Dierl, Allen, TX (US); Jay Edward Gehring, Frisco, TX (US); Anthony Robert Knoerzer, Parker, TX (US); Garrett William Kohl, Allen, TX (US); Jerry Mike Reaves, Midlothian, TX (US); Steven Kenneth Tucker, Hurst, TX (US); Jeryl Edwin White, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 11/232,796

(22) Filed: Sep. 22, 2005

(65) Prior Publication Data

US 2007/0062161 A1 Mar. 22, 2007

(51) Int. Cl.
*B65B 61/18* (2006.01)
*B65B 9/06* (2006.01)

(52) U.S. Cl. ..... 53/412; 53/451; 53/133.4; 53/551

(58) Field of Classification Search ..... 53/412, 53/133.4, 139.2, 451, 552
See application file for complete search history.

(56) References Cited

U.S. PATENT DOCUMENTS 3,425,185 A * 2/1969 Arthur et al. ..... 53/552
3,537,636 A 11/1970 Rochette
3,595,468 A 7/1971 Repko
3,613,874 A 10/1971 Miller
3,785,112 A 1/1974 Leasure et al.
3,785,636 A 1/1974 Bitting et al.
4,194,438 A 3/1980 Schmachtel
4,355,494 A * 10/1982 Tilman ..... 53/416
4,532,754 A * 8/1985 Hokanson ..... 53/451
4,543,139 A 9/1985 Freedman et al.
4,584,201 A 4/1986 Boston
4,597,103 A 6/1986 Hoover
4,604,854 A 8/1986 Andreas (Continued)

FOREIGN PATENT DOCUMENTS

EP 0 596 747 A1 5/1994

(Continued)

*Primary Examiner*—Stephen F. Gerrity
(74) *Attorney, Agent, or Firm*—Carstens & Cahoon, LLP; Colin P. Cahoon; Chad E. Walter

(57) ABSTRACT

A flexible package having an integrated reclose strip, and method for manufacturing same, constructed by modification to existing vertical form and fill packaging machines. The reclose strip comprises a length of tacky two-sided adhesive tape. The apparatus for applying a reclose strip is incorporated into the mechanism which supplies the continuous sheet of packaging material to the vertical form, fill, and seal machine. The invention involves producing a pillow pouch or vertical stand-up pouch having an integrated reclose strip from a single sheet of packaging film. In one aspect, the reclose strip comprises a release liner on one side after package formation. In one aspect, the reclose strip comprises no release liner and is attached along the longitudinal axis of the sheet of packaging material such that the reclose strip is disposed in a channel or recess in the fill tube. The reclose strip permits the package to be reclosed after initial opening without folding the package.

7 Claims, 6 Drawing Sheets

U.S. PATENT DOCUMENTS 4,785,940 A 11/1988 Wilson
4,786,190 A 11/1988 Van Erden
4,894,975 A 1/1990 Ausnit
4,913,561 A 4/1990 Beer
4,925,438 A 5/1990 Wagner
4,986,054 A 1/1991 McMahon
5,030,190 A 7/1991 Woods et al.
5,044,776 A 9/1991 Schramer et al.
5,046,300 A 9/1991 Custer et al.
5,072,571 A * 12/1991 Boeckmann ..... 53/133.4
5,089,320 A 2/1992 Straus et al.
5,127,208 A 7/1992 Custer et al.
5,170,608 A 12/1992 Petry et al.
5,172,854 A 12/1992 Epstein et al.
5,242,516 A 9/1993 Custer et al.
5,322,579 A 6/1994 Van Erden
5,382,472 A 1/1995 Yanidis et al.
5,398,486 A 3/1995 Kauss et al.
5,400,565 A 3/1995 Terminella et al.
5,400,568 A * 3/1995 Kanemitsu et al. ..... 53/412
RE34,905 E 4/1995 Ausnit
5,412,924 A 5/1995 Ausnit
5,417,040 A 5/1995 Davoren
5,425,216 A 6/1995 Ausnit
5,505,037 A 4/1996 Terminella
5,527,112 A 6/1996 Dais
5,529,394 A 6/1996 Davoren
5,551,208 A 9/1996 Van Erden
5,561,966 A 10/1996 English
5,564,259 A 10/1996 Stolmeier
5,564,834 A 10/1996 Porchia et al.
5,590,783 A 1/1997 Capy et al.
5,746,043 A 5/1998 Terminella et al.
5,768,852 A 6/1998 Terminella et al.
5,768,969 A 6/1998 Dalfiume
5,832,145 A 11/1998 Dais et al.
5,862,652 A 1/1999 Schoeler
5,930,983 A 8/1999 Terminella et al.
5,983,594 A * 11/1999 Forman ..... 53/133.5
5,993,962 A 11/1999 Timm et al.
6,029,428 A 2/2000 Terminella et al.
6,047,521 A 4/2000 Terminella et al.
6,076,969 A 6/2000 Jaisle et al.
6,145,282 A 11/2000 Tsuruta
6,202,260 B1 * 3/2001 Clune et al. ..... 24/30.5 R
6,244,748 B1 6/2001 Kasai et al.
6,279,298 B1 8/2001 Thomas et al.
6,327,837 B1 * 12/2001 Van Erden ..... 53/412
6,398,412 B2 6/2002 Wedi et al.
6,461,044 B1 10/2002 Anderson
6,481,183 B1 11/2002 Schmidt
6,502,986 B1 1/2003 Bensur et al.
6,615,567 B2 9/2003 Kuhn et al.
6,729,109 B2 5/2004 Knoerzer et al.
6,769,229 B2 * 8/2004 Kinigakis et al. ..... 53/412
6,777,050 B1 8/2004 Engelaere
6,860,084 B2 * 3/2005 Knoerzer et al. ..... 53/133.4
6,871,473 B1 * 3/2005 Dutt et al. ..... 53/133.4
7,032,362 B2 * 4/2006 Dierl et al. ..... 53/410
2003/0009989 A1 1/2003 Knoerzer et al.
2003/0044558 A1 3/2003 Lee et al.
2004/0091183 A1 * 5/2004 Dierl et al. ..... 383/104
2005/0031233 A1 2/2005 Varanese et al.

FOREIGN PATENT DOCUMENTS

GB DES. 2101909 5/2001
JP 2191159 7/1990
WO WO 93/19996 10/1993

* cited by examiner

METHOD FOR MAKING A FLEXIBLE RECLOSABLE PACKAGE

BACKGROUND OF THE INVENTION

1. Technical Field

The present invention relates to a pillow or vertical stand-up pouch having an inside reclose strip constructed using a modified vertical form and fill packaging machine, and the method for making same, that provides for a single piece construction of a reclosable vertical stand-up bag suitable for retail snack food distribution. The invention allows for use of existing film converter and packaging technology to produce a package for moisture sensitive food products or the like with minimal increased costs and minimal modification. The resulting package may be opened, a part of the contents removed and the package resealed to prevent premature deterioration of the quality of the contents because of exposure to moisture.

2. Description of Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting across the sealed area.

The packaging film used in such process is typically a composite polymer material produced by a film converter. For example, one prior art composite film used for packaging potato chips and like products is illustrated in FIG. 1, which is a schematic of a cross-section of the film illustrating each individual substantive layer. FIG. 1 shows a sealable inside, or product side, layer 16 which typically comprises metalized oriented polypropylene ("OPP") or metalized polyethylene terephtalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

The prior art film composition shown in FIG. 1 is ideally suited for use on vertical form and fill machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package.

Typical back seals formed using the film composition shown in FIG. 1 are illustrated in FIGS. 2*a* and 2*b*. FIG. 2*a* is a schematic of a "lap seal" embodiment of a back seal being formed on a tube of film. FIG. 2*b* illustrates a "fin seal" embodiment of a back seal being formed on a tube of film.

With reference to FIG. 2*a*, a portion of the inside metalized layer 26 is mated with a portion of the outside layer 20 in the area indicated by the arrows to form a lap seal. The seal in this area is accomplished by applying heat and pressure to the film in such area. The lap seal design shown in FIG. 2*a* insures that the product to be placed inside the formed package will be protected from the ink layer by the metalized inside layer 26.

The fin seal variation shown in FIG. 2*b* also provides that the product to be placed in the formed package will be protected from the ink layer by the metalized inside layer 26. Again, the outside layer 20 does not contact any product. In the embodiment shown in FIG. 2*b*, however, the inside layer 26 is folded over and then sealed on itself in the area indicated by the arrows. Again, this seal is accomplished by the application of heat and pressure to the film in the area illustrated.

Regardless of whether a lap seal or fin seal is used for constructing a standard package using a vertical form, fill, and seal packaging machine, the end result is a package as shown in FIG. 3 with horizontally oriented top and bottom transverse seals 31,33. Such package is referred to in the art as a "vertical flex bag" or "pillow pouch," and is commonly used for packaging snack foods such as potato chips, tortilla chips, and other various sheeted and extruded products. The back seal discussed with reference to FIGS. 2*a* and 2*b* runs vertically along the bag and is typically centered on the back of the package shown in FIG. 3, thus not visible in FIG. 3. Because of the narrow, single edge base on the package shown in FIG. 3 formed by the bottom transverse seal 33, such prior art packages are not particularly stable when standing on one end.

One method and apparatus for making a vertical stand up pouch is disclosed by U.S. Pat. No. 6,722,106, assigned to the same assignee of the present invention and hereby incorporated by reference. One benefit of a vertical stand-up pouch is that it can function as a bowl. Thus, it can be set on a table in the opened position without fear of spilling product. It would be desirable to add a reclosable feature to a vertical stand up pouch.

Many of the reclosable packages disclosed in the prior art utilize a mechanical reclosure means such as interlocking mechanical profiles to fasten the interior package walls together to close the package mouth or an adhesive reclosure means whereby at least a portion of the adhesive is adhered to the outside of the package to close the package mouth. Use of interlocking strips, however, such as zippers or sliders is costly, and complicates the manufacture of packaging. For example, a pair of interlocking strips typically requires that a different interlocking strip, one male and one female, be adhered, by a heat seal or by an adhesive, on opposite inner package walls. Even if the interlocking strips are initially fastened together and initially mated to only one inner package wall, the interlocking strips must eventually be adhered to both opposite inner package walls to function as a reclose strip. If the strips are not fastened prior to adherence to an inner package wall, the strips must then be placed in opposite alignment with one another while on the bagmaker so as to properly function as a reclose mechanism.

Another prior art solution is to use a single sided tape adhered to the outside of a package to close the package. Adhesive adhered to the outside of packages is undesirable because it is difficult to achieve the tight seal desired to keep the contents of an open, rolled-up bag fresh. Further, if the adhesive is strong enough to effect such a bond, it is usually difficult to effect initial release from the outer package wall. Consequently, a need exists for an apparatus and method for making a reclosable pillow pouch in an economical manner that does not use mechanical or interlocking strips and does not require an adhesive on the outside of the package to keep the package closed. Further, use of the reclosable mechanism should be intuitive to a consumer.

U.S. Pat. No. 3,595,468, issued on Jul. 27, 1971, discloses an improved opening device for boil-in-the-bag type packages. The '468 Patent discloses feeding a "heat-sealable strip or tape 34" onto the web face 16 from a supply roll 38. Placement of the strip 34 is below two terminal ends 58 60 of the package extending between two end seals 46 and uses heat and/or pressure to form a seal between the two inner face portions 54 56 of the package. The '468 Patent is not directed towards use in a vertical form, fill and seal machine.

U.S. Pat. No. 3,613,874, issued on Oct. 19, 1971, discloses a reclosable package having a tape heat-sealed between facing members of a flexible pouch adjacent a top edge. Immediately below and parallel to the tape 20 is a tear strip 30. The tear strip 30 extends across the entire front panel of the pillow-pouch type package and around the two side edges and part way across the back panel of the package. Thus, when the tear strip 30 is removed, the front panel above the tear strip is also removed, exposing a pressure sensitive adhesive 7, or tape on the remaining back panel. The back panel having the tape must then be folded over the exterior of the lower portion containing unconsumed product. The '874 Patent requires placement of the adhesive in the transverse direction rather than the machine direction and does not utilize the adhesive to adhere the inner facing package members.

U.S. Pat. No. 4,543,139, issued on Sep. 24, 1985, assigned to Avery International Corporation, discloses a high adhesion or permanent type first pressure sensitive adhesive 11 adjacent a second low adhesion pressure sensitive adhesive 12. The adhesive combination 11 12 can then be placed between a first substrate portion 31 and a second substrate portion 32 to resealably hold the portions 31 32 together. The patent teaches that an end user's action in reopening and redosing the package gradually and progressively mixes the adhesives 11 and 12 to compensate for the adverse effect of contamination on reseal adhesion at the reseal surface 16. The patent is directed towards placement on the outside of a package.

Consequently, a need also exists for a simpler apparatus and method of incorporating an inside reclose strip into a pillow or a vertical stand-up, flat bottom pouch using the vertical form, fill, and seal machine technology. The apparatus and method should allow for ease in size change, and little capital outlay, all while maintaining bag forming speeds typical of vertical form, fill, and seal machine pillow pouch production. Such apparatus and method should ideally produce a pillow pouch or a vertical stand-up pouch having an inside reclose strip, and constructed of material commonly used to form standard vertical flex bags.

SUMMARY OF THE INVENTION

The proposed invention involves producing a pillow pouch or a vertical stand-up pouch or package having an inside reclose strip, and constructed of a single sheet of packaging material using a slightly modified vertical form, fill, and seal machine.

In a pillow pouch embodiment, the modified machine includes an apparatus for applying a reclose strip to the sheet of material and a recessed fill tube. The apparatus for applying a reclose strip is incorporated into the vertical form, fill, and seal machine. The reclose strip can be attached along the longitudinal axis of the sheet of packaging material prior to forming the sheet into a tube in the conventional manner. Alternatively, the reclose strip can be attached along the longitudinal axis of the sheet after formation into a tube in the conventional manner.

In a vertical stand-up pouch embodiment, the modified machine includes a crease-forming mechanism, an apparatus for applying a reclose strip to the sheet of material, and a recessed fill tube. The crease-forming mechanism includes a tension bar and forming plates located below the forming tube and a stationary but adjustable tucker mechanism mounted to the frame of the machine which, when positioned between the two forming plates, creates a vertical tuck along the length of the package while it is being formed.

Further, in the vertical stand-up pouch embodiment, graphics on the packages are oriented 90° from a standard presentation such that the tuck forms the bottom of the package. The reclose strip can be easily added to the manufacture of such a vertical stand-up package since the inside reclose strip, which is attached along the longitudinal axis of the sheet of packaging material, can accompany the single sheet of packaging film through a vertical form, fill, and seal machine in the conventional manner. The transverse seals on the formed package are therefore oriented vertically and the reclose strip is oriented horizontally when the package is placed on display. Thus, when opened, the top of the package can be removed above a scoreline, product can be retrieved, and the package can be reclosed by application of pressure and pressed against the exposed adhesive strip thereby providing a reclosable seal feature. After package formation, the reclosable package rests on a bottom gusset and the sides are bounded by end seals formed from the sealing jaws.

In one embodiment, the reclosable package has a circumferential score line near the top of the package. Below the circumferential score line, a reclose strip is secured to one or both of the inside walls across the top of the package, from end seal to end seal. In one embodiment, a first side of the reclose strip is adhered on an inside package wall and a release liner is disposed on a second side of the reclose strip. The package is initially opened by tearing the top portion of the package above the circumferential score line off of the package to create two exposed film terminal ends that are joined together by the reclose strip. One exposed film terminal end is from the front of the package and the other exposed terminal end is from the back of the package. The reclose strip comprises a length of tacky two-sided adhesive tape. The reclose strip applied to the inside layer of packaging film is more strongly adhesive on one side and adhesively adheres the two terminal ends together. The reclosable package can then be opened on the consumer side, (above the reclose strip) or on the product side (below the reclose strip) by pinching the flexible film on the front of the package and the back of the package with thumb and index finger of each hand and pulling the two terminal ends apart. The package may then be reclosed by applying pressure to reclose strip across the top of the package. Pressure can be applied in this fashion by pulling each end seal in opposite directions. Alternatively, a pair of fingers can apply pressure across the top of the package between the end seals. The package can then be re-opened and re-closed as desired by the consumer.

The method disclosed and the package formed as a consequence is a substantial improvement over prior art reclosable packages. The method works on existing vertical form, fill, and seal machines requiring very little modification. There are no substantial moving parts or jaw carriage modifications involved with the crease-forming mechanism. Moreover, the apparatus for applying the reclose strip may be easily incorporated into the supply mechanism that supplies the continuous sheet of packaging material to the vertical form, fill, and seal machine.

The modified vertical form, fill, and seal machines can also be easily converted back to a conventional pillow pouch configuration by selectively disengaging the crease-forming mechanism and discontinuing the supply of reclose strip. The same metalized or clear laminations used as materials in pillow pouches can also be used with the invention therefore saving in per bag cost. The invention allows for the formation of bags that emulate a horizontal stand-up pouch using a completely different method that takes advantage of the economics of vertical form and fill machine technology.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

Figure 1:
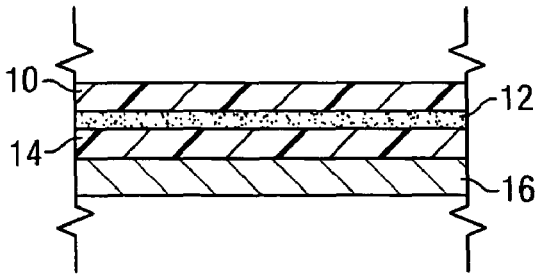
FIG. 1 (PRIOR ART)
FIGS. 1 is a schematic cross-section views of prior art packaging films.
Figure 2A:
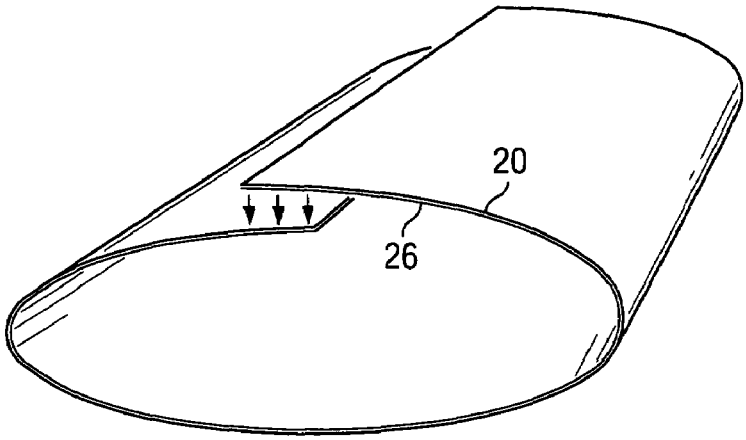
FIG. 2a (PRIOR ART)
FIG. 2*a* is a schematic cross-section view of a tube of packaging film illustrating the formation of a prior art lap seal.
Figure 2B:
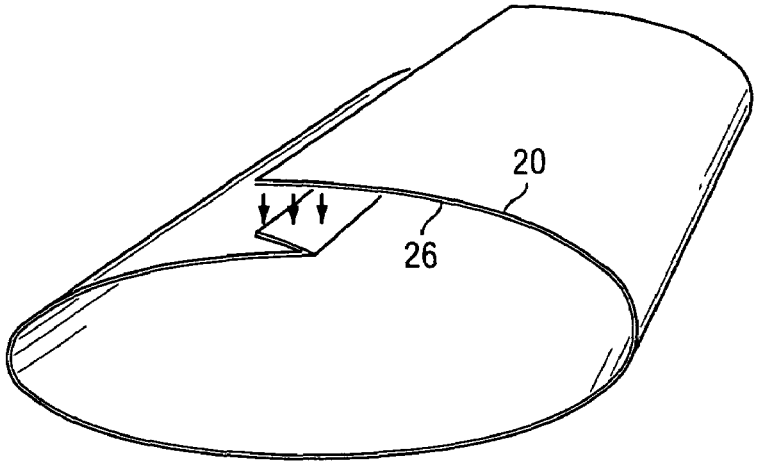
FIG. 2b (PRIOR ART)
FIG. 2*b* is a schematic cross-section of a tube of packaging film illustrating the formation of a prior art fin seal.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION

Figure 4:
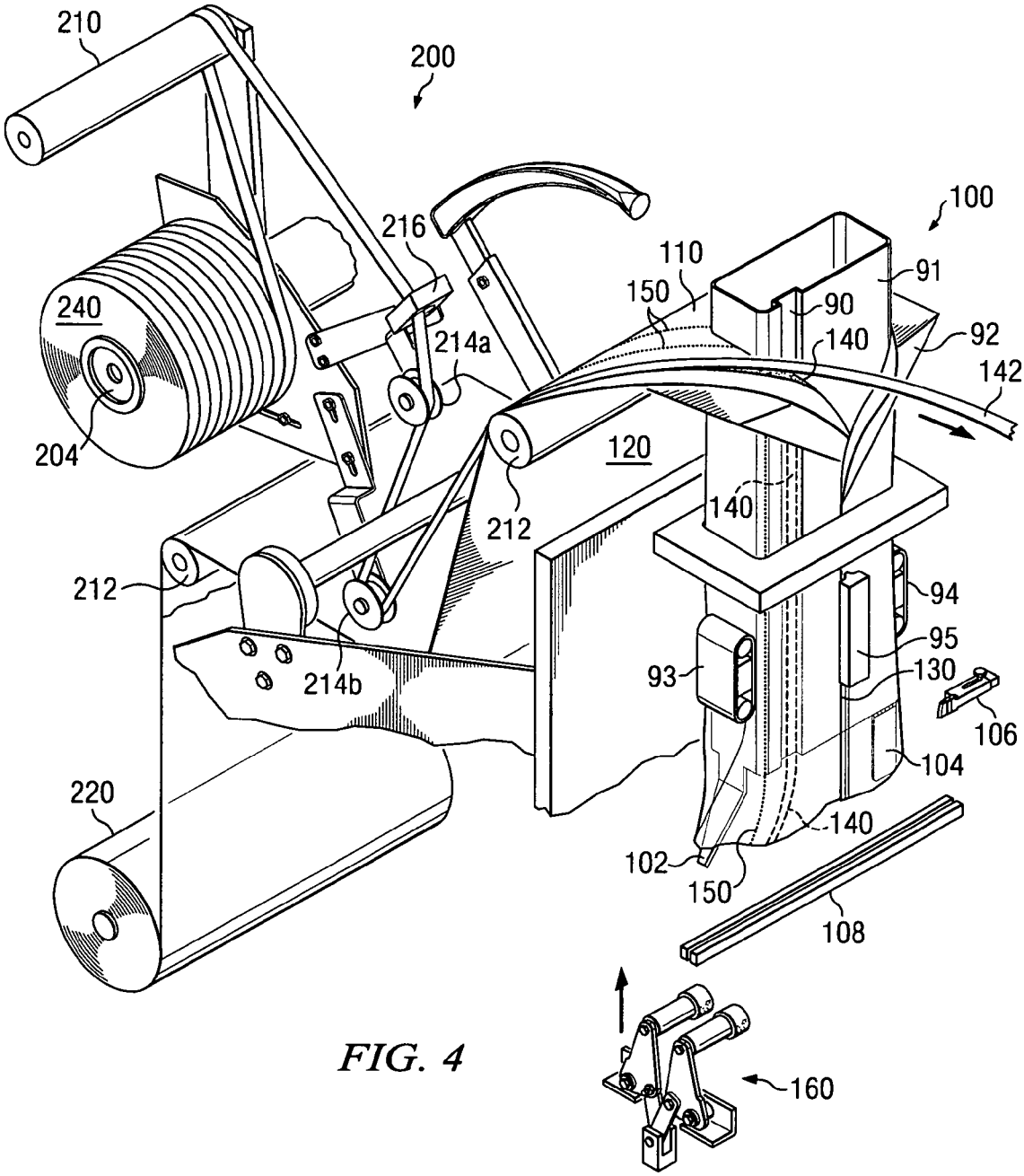
FIG. 4 is a simplified perspective view of a vertical form, fill, and seal machine adapted to manufacture a stand-up package having an integrated reclose strip in accordance with the present invention.

FIG. 4 is a simplified perspective view of a vertical form, fill, and seal machine adapted to manufacture a stand-up package having an integrated reclose strip in accordance with one embodiment of the present invention. As used herein reclose strip is synonymous with tacky two-sided adhesive tape. The apparatus for supplying and applying the reclose strip 200 is incorporated into the vertical form, fill, and seal machine 100.

As shown in FIG. 4, the vertical form, fill, and seal machine 100 includes a recessed forming/fill tube 91 having a channel 90 and a former section 92 around which a sheet of packaging material 120 is directed and formed into a tubular shape in the conventional manner. The recess in the forming tube is only required when the reseal tape liner 142 is removed. While the forming/fill tube 91 illustrated in FIG. 4 is shown as having a rectangular cross-sectional shape, it is understood that the cross-sectional shape of the forming/fill tube 91 may be any of various other shapes, such as circular, oval, or square.

As will be subsequently explained in greater detail, the supply mechanism 200 includes an apparatus incorporated therein, which attaches a length of reclose strip 140 to the forming/fill tube 91 side of the sheet of packaging material 120 such that when the sheet of packaging material 120 is supplied to the vertical form, fill, and seal machine 100 and formed into a tubular shape in the conventional manner, the reclose strip 140 is positioned along a longitudinal axis on the inner surface of the formed tube.

Figure 5:
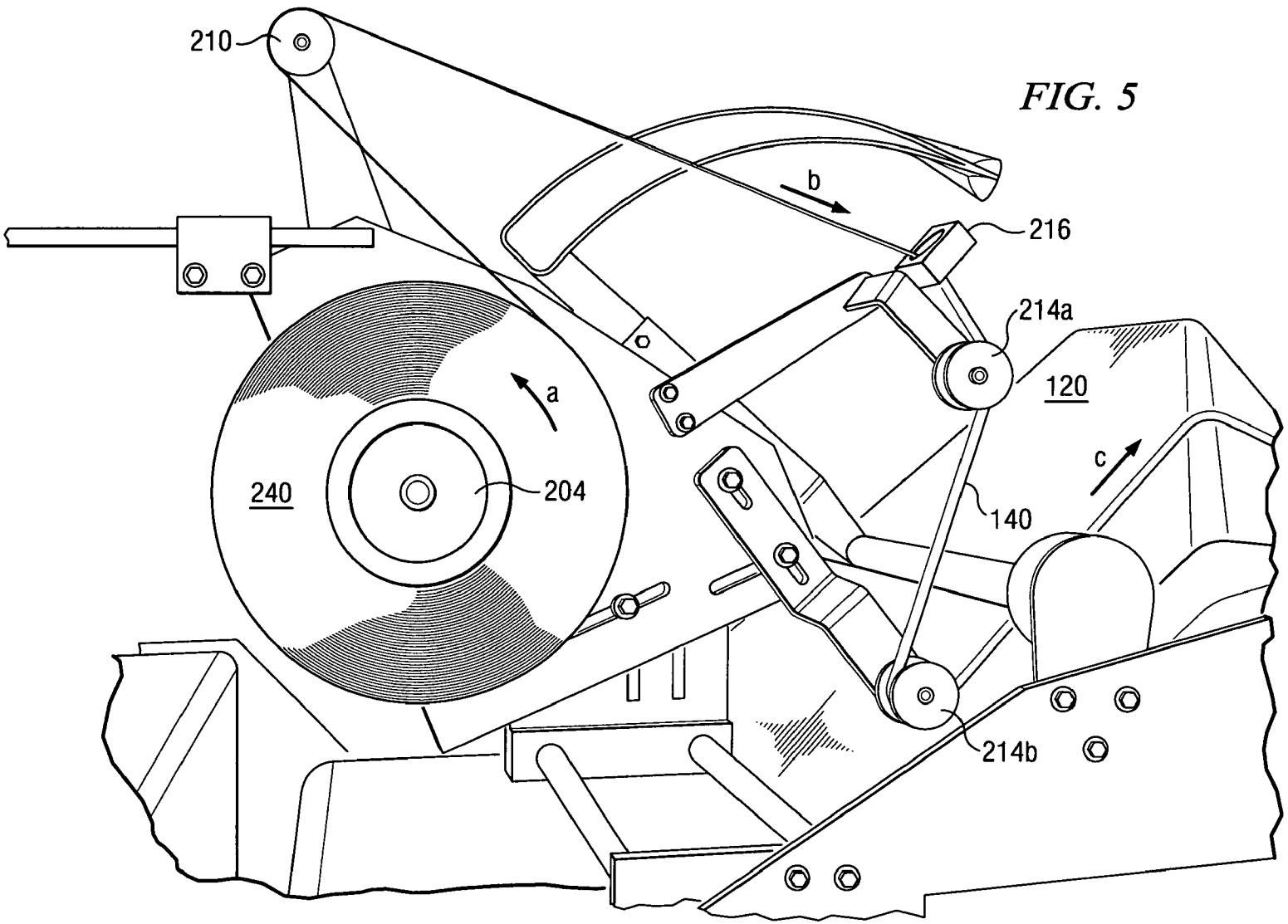
FIG. 5 is a side view of a reclose strip supply mechanism supplying the reclose strip to film the form, fill, and seal machine shown in FIG. 4.

FIG. 5 is a side view of a reclose strip supply and application mechanism supplying the reclose strip to film on the form, fill, and seal machine shown in FIG. 4. Referring now to FIGS. 4 and 5, an embodiment of the supply reclose strip mechanism 200 depicted in FIG. 4 is shown that includes an apparatus for applying a length of reclose strip 140 to the sheet of packaging material or film 120 being supplied to the vertical form, fill, and seal machine 100. The supply mechanism 200 also includes a mechanism for unrolling the reclose tape 140 and applying it to a sheet of packaging material 120 from a supply spool 220 so as to direct a continuous sheet towards the vertical form, fill, and seal machine 100. The vertical form, fill, and seal machine supply spool 220 unrolls a sheet of packaging material 120 which is fed through the series of rollers 212 in the direction of arrow c.

Of particular note, the supply mechanism 200 of the present invention also includes an apparatus for applying a length of reclose strip 140 to the sheet of packaging material or film 120. As shown in the Figures, the apparatus includes a spool unwind 204 onto which a spool 240 of reclose strip 140 is attached, a tensioning roller 210, tape guide 216, and a series of rollers 214*a, b*.

In accordance with the present invention, a length of reclose strip 140 is unwound from spool 240 and fed through a series of rollers 210 214 in the direction of the arrows a, b, and c, to the peripheral surface of the sheet of packaging material 120 being advanced from the vertical form, fill, and seal machine supply spool 220. In one embodiment, the spool unwind 204 comprises a tensioning device to properly tension the tape spool 240. In one embodiment, as best depicted by FIG. 4, the tape spool 240 is several times wider than the width of the reclose strip 140 and reclose strip 140 is dispensed back and forth across the width of the spool 240. In one embodiment, the reclose strip 140 comprises a release liner 142 to facilitate removal of the reclose strip 140 from the spool 240. As the reclose strip 140 is dispensed and moves back and forth across the width of the spool 240, the reclose strip 140 moves about the width of the tension roller 210. A guide 216 can be used to align the reclose strip with the rollers 214*a,b* for correct positioning as the tape crosses the wide tension roller 210. In one embodiment, as the reclose strip 140 is dispensed from the wide tension roller 210, the circle inside the square of the guide 216 uses tension pressure of the reclose strip 140 for alignment.

Once attached to the sheet of packaging material 120, the length of reclose strip 140 is, thereafter, continually and automatically unwound from spool 240 and applied to the sheet of packaging material 120 by the periodic advance of the sheet of packaging material 120 from the supply spool 220 of the vertical form, fill, and seal machine 100. Referring to FIG. 4, in one embodiment, the release liner 142 is removed from the reclose strip 140 after the reclose strip 140 has been applied to the packaging material 120. In an alternative embodiment, the release liner 142 remains on one side of the reclose strip 140 for later removal by the consumer after initially opening the package. To avoid contact with the fill tube 91, the reclose strip 140 is placed onto the film 120 such that the two-sided adhesive is disposed along a channel 90 in the fill tube 91 when the film tube is created to prevent contact between the fill tube 91 and the reclose strip 140. In an alternative embodiment, where the release liner 142 is not removed, the channel 90 is not required. The reclose strip 140 is applied to the sheet of packaging material such that when the sheet of packaging material is supplied to the vertical form, fill, and seal machine 100 and formed into a tubular shape in the conventional manner, the reclose strip 140 is positioned along a longitudinal axis on the inner surface of the formed tube. Thus, as shown in FIG. 4, the length of reclose strip 140 is attached to the inside tube of the sheet of packaging material 120 such that when the sheet of packaging material 120 is supplied by the vertical form, fill, and seal machine supply mechanism 220 of the present invention to the vertical form, fill, and seal machine 100 and formed into a tubular shape in the conventional manner, the reclose strip 140 is positioned along a longitudinal axis preferably in relatively close proximity to one of the score lines 150 on the inner surface of the formed tube. In an alternative embodiment (not shown), the reclose strip is placed directly on the inner surface after the film tube is formed.

With reference once again to FIG. 4, the tubular shaped packaging film 120 is driven downward by an advancing mechanism (e.g., friction against rotating belts 93,94), whereupon a heat seal bar 95 contacts the tubular shaped packaging film imparting a vertical back seal 130 and forming a tube. As the formed tube is advanced down the forming/fill tube 91, the length of reclose strip 140 attached to the interior of the formed tube is also advanced.

Also shown in FIG. 4 are a pair of prior art sealing jaws 108 illustrated in elevation. Not shown in FIG. 4 is the sealing jaw carriage on which such sealing jaws 108 would be mounted below the forming/fill tube 91.

At the bottom of the forming/fill tube 91, in a vertical stand-up pouch embodiment, a crease-forming mechanism comprised of two forming plates 104, a fixed or stationary tucker mechanism 106, and a tension bar 102, is installed which modifies the standard vertical form, fill, and seal machine 100 so as to produce a stand-up packages. The forming plates 104 can swing towards each other by rotating about a hinge, a spring steel, counterweight, etc (not shown). This arrangement allows for the forming plates 104 to rotate towards one another and avoid ripping of the packaging film 120 when transverse seals are being formed below the forming plates 104 by the transverse seal jaws 108 as shown in FIG. 4.

Score lines can be placed on the packaging film 120 shortly after or during film formation before it is rolled into the supply spool. Score lines can be spaced apart on the flexible film such that a resultant circumferential score line 150 is formed when the film is formed into a tube. In a preferred embodiment, a slit score, such as disclosed in European Patent Application 0 596 747 A1, assigned to Curwood, Inc. of Oshkosh, Wis. can be used.

In the vertical stand-up pouch embodiment, the two forming plates 104 and the tension bar 102 are used to hold the formed tube in tension from inside of the tube. Tension is applied on the exterior surface of the formed tube and in the opposite direction of the tension provided by the forming plates 104 by the tucker mechanism 106, alternatively referred to herein as a tucker bar 106, positioned between said forming plates 104.

When moved forward into position (i.e., toward the forming plates 104), the tucker bar 106 provides a crease or fold in the tube of the packaging film between the two forming plates 104. This crease is formed prior to formation of the transverse seal by the seal jaws 108. Consequently, once the transverse seal is formed, the crease becomes an integral feature of one side of the package.

A pair of heat-sealing jaws 108 are applied against the film tube to form a transverse seal such that two score lines 150, previously placed onto the package film, are aligned and form a circumferential score line 150. In one embodiment, after the sealing jaws 108 form each transverse seal, the inner package walls below the circumferential score line 150 are adhered together by the reclose tape 140 and a pinching mechanism 160. In one embodiment, the pinching mechanism 160 comprises two rollers. As the bag moves downward, the pinching mechanism 160 applies pressure to the reclose strip 140 and the inner film wall opposite the reclose strip 140 to adhere the inner package walls together prior to placement of product into the film tube. In one embodiment, the pinching mechanism 160 remains stationary as the bag is driven downwards between the rollers and then pinching mechanism 160 moves upward after the bag has finished its downward movement to ensure application of pressure has been applied from end seal to end seal. In an alternative embodiment, a release liner 142 remains on a first side of the reclose strip 140 and a pinching mechanism 160 may not be needed if the second side can be securely fastened to the inner package wall without such mechanism 160. Although a specific pinching mechanism 160 has been described above, such description is provided for purposes of illustration and not limitation. Any pinching mechanism which applies pressure to the reclose strip and the inner film wall can be used.

The product to be packaged is then dropped through the fill tube 91 and is held within the film tube above a transverse seal. This transverse seal acts as the right side seal (after package formation) on the bag below the sealing jaws and the left side seal (after package formation) on the bag being filled and formed above the jaws 108. After the transverse seal has been formed, a cut is made across the sealed area to separate the finished bag below the seal from the partially completed bag above the seal. The film tube is then pushed downward to draw out another package length.

Figure 3:
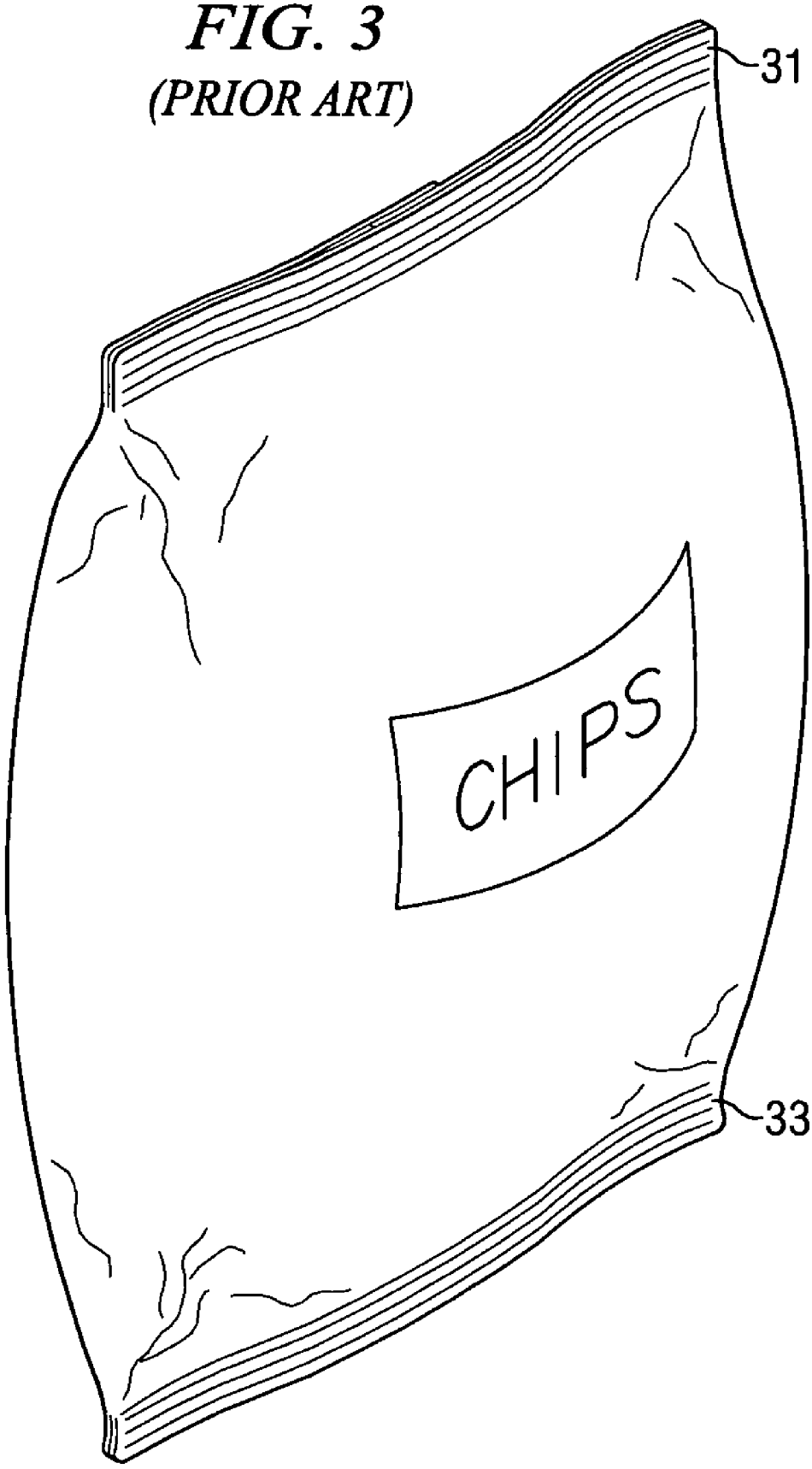
FIG. 3 (PRIOR ART)
FIG. 3 is a perspective view of a prior art vertical flex bag.
Figure 6B:
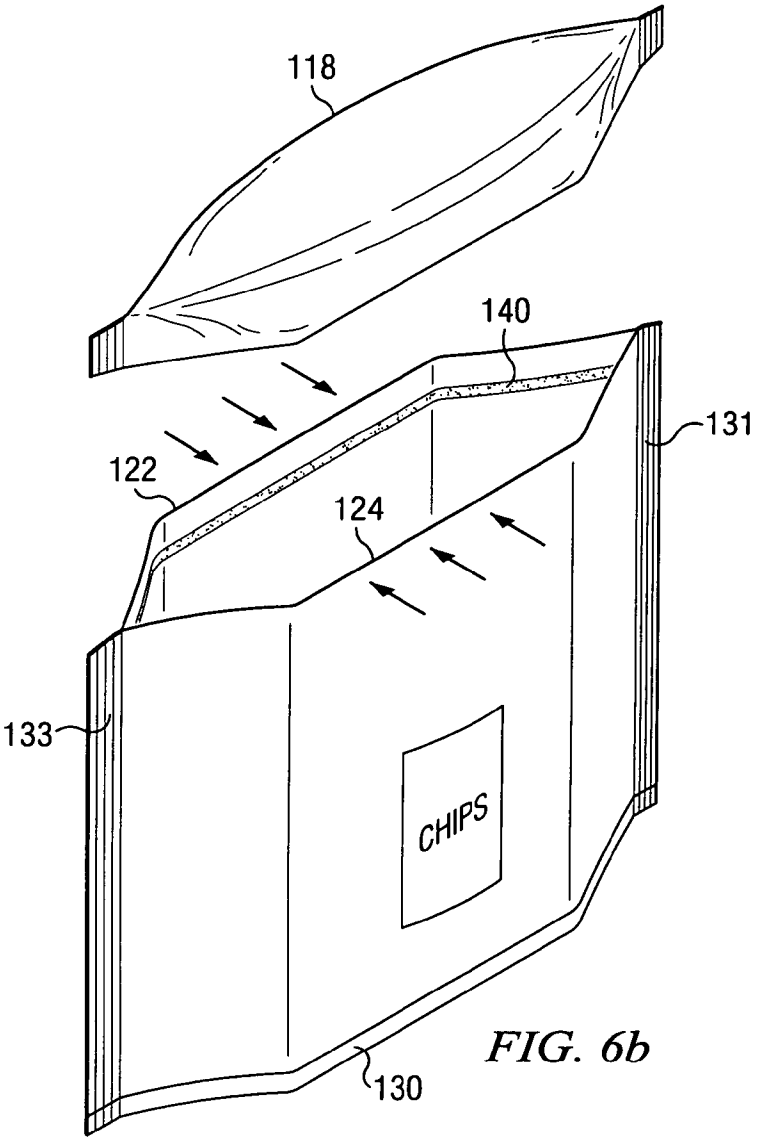
FIG. 6*b* is a top perspective view of an opened vertical stand up pouch having an inside reclose strip in accordance with one embodiment of the present invention.
Figure 6A:
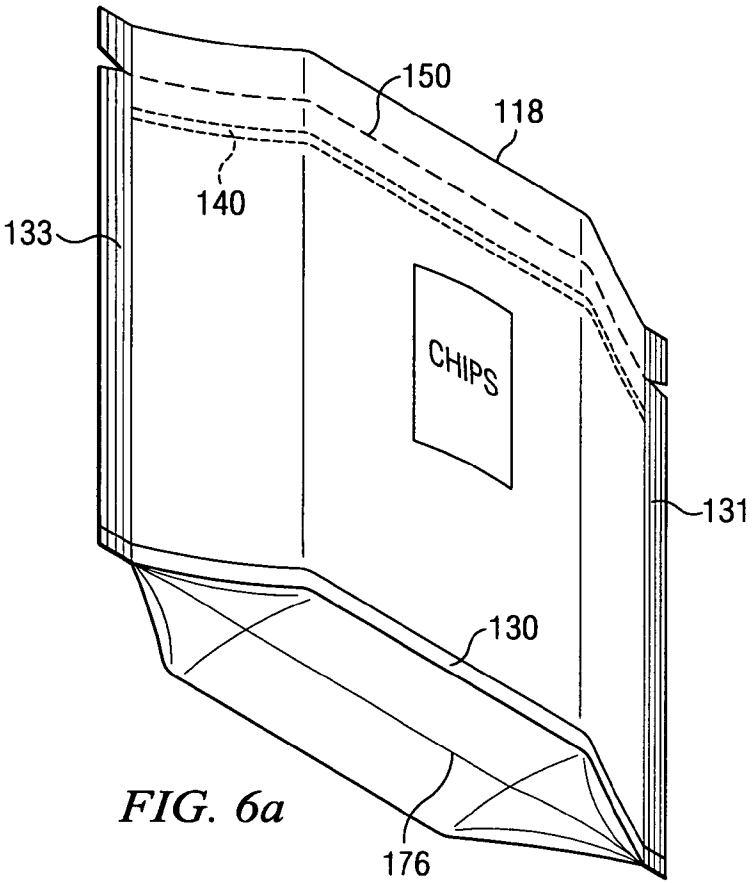
FIG. 6*a* is a bottom perspective view of a vertical stand up pouch having an inside reclose strip in accordance with one embodiment of the present invention.

FIG. 6*a* is a bottom perspective view of a resultant vertical stand up pouch having an inside reclose strip in accordance with one embodiment of the present invention. FIG. 6*b* is a top perspective view of a resultant opened vertical stand up pouch having an inside reclose strip in accordance with one embodiment of the present invention. As shown in FIGS. 6*a*-6*b* the construction of the invention's vertical stand-up pouch shares characteristics with the prior art vertical flex bags shown in FIG. 3. However, the transverse seals 131, 133 of the vertical stand-up bag of the invention are oriented vertically and the vertical back seal 130 is oriented horizontally once the bag stands up on one end, as shown in FIG. 6*b*. It should be pointed out that although the back seal 130 is depicted as being on the front bottom portion of the package, the back seal 130 can be placed along any horizontal location including on the back, middle portion of the bag. FIG. 6*a* shows the crease 176 that is formed by the tucker bar 106 and forming plates 104 and a segment length of reclose strip 140 in phantom positioned and applied on the package interior.

The reclose strip 140 used in the present invention may be of any conventional construction. The reclose strip 140 is a length of two sided tape with a more aggressive adhesive on one side. The pull force to reclose the weaker side of reclose strip 140 is lower than the pull force that would separate any layers of film, or pull the tape from the opposite side wall. The reason for this is simple. It is desired that the reclose strip 140 remain bonded to the internal surface of the packaging material 120. Therefore, the bonding strength of one side of the tape must be stronger than the release side. Otherwise, the reclose strip 140 would peel off of the package.

After package formation, the reclosable package rests on a bottom gusset and the sides are bounded by end seals formed from the sealing jaws. The reclosable package has a circumferential score line 150 near the top of the package. Below the circumferential score line 150, the reclose strip 140 is secured to both of the inside walls across the top of the package, from end seal to end seal. In an alternative embodiment where liner 142 is left on, the reclose strip 140 is secured to one inside wall and both end seal walls.

In typical use, the resulting vertical stand-up pouch or package having an integrated reclose strip shown in FIGS. 6*a* and 6*b* is opened by cutting or tearing the top portion 118 of the package to provide two terminal ends 122 that form an opening allowing the user to retrieve the contents of the package or a part thereof. Oftentimes, not all the contents of a package are consumed at one time and thus the desire to close and reseal the package is achieved where the package is manufactured according to the above discussed procedure. The package may be opened to remove part of the contents and resealed to prevent moisture from causing premature deterioration of the contents. The package can then be re-opened and reclosed as desired by the consumer.

While the reclose strip 140 is functional any place within the headspace of the package, it is desirable that the reclose strip 140 be applied on the upper half of the resulting package and preferably in a position just beneath the score-line 150.

Figure 7:
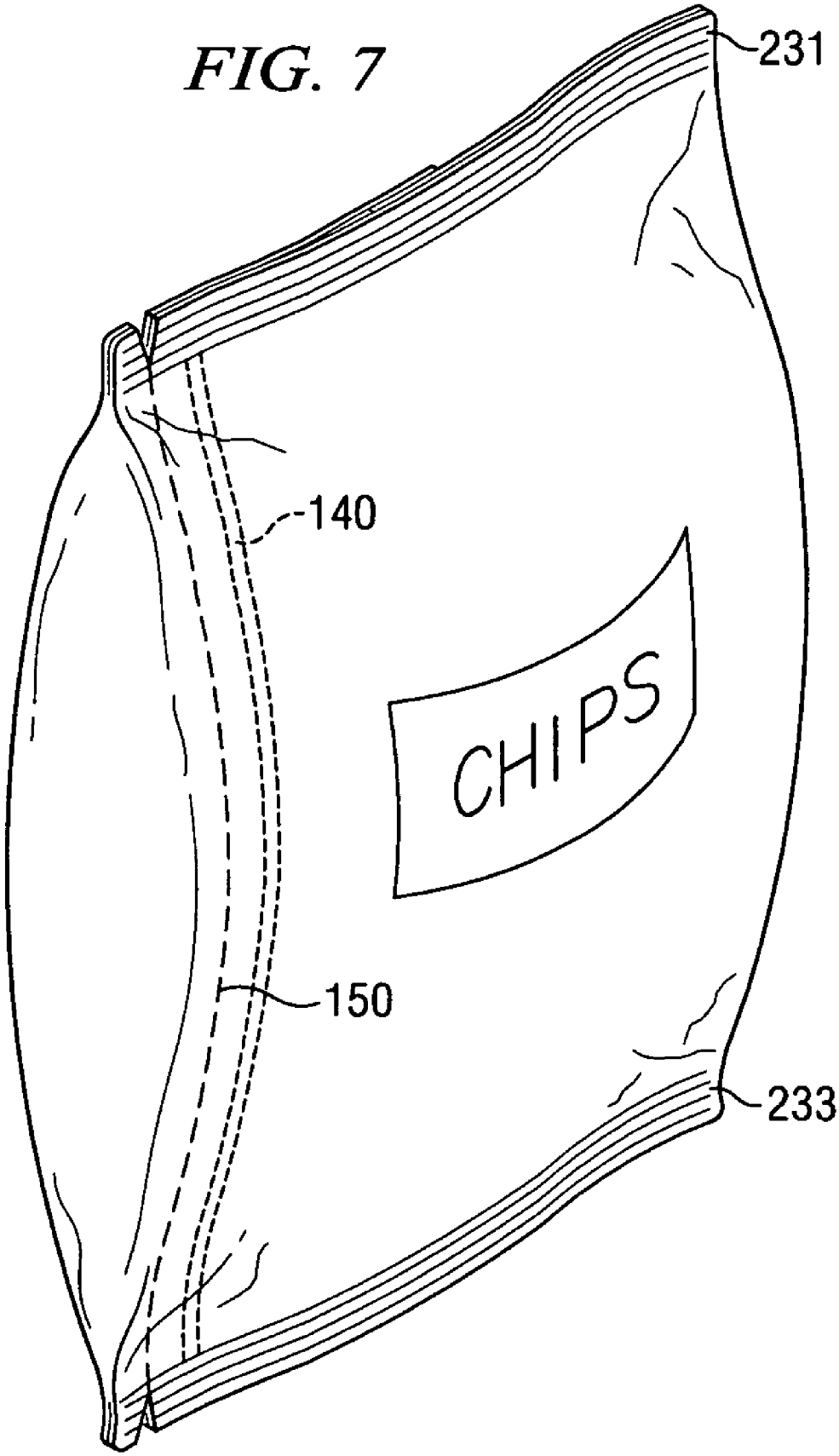
FIG. 7 is a perspective view of a vertical flex bag having an inside reclose strip in accordance with one embodiment of the present invention.

Although one embodiment of the invention is directed towards a vertical stand-up pouch embodiment, it should be noted that the instant invention can be directed towards a pillow pouch embodiment as well. For example, a pillow pouch having an inside reclose strip can be made from the machine depicted in FIG. 4, with the omission of the gusseting equipment including the tension bar 102, forming plates 104 and tucker bar 106. FIG. 7 is a perspective view of a vertical flex bag or pillow pouch having an inside reclose strip in accordance with one embodiment of the present invention. Graphics on the package are oriented in the standard presentation and the bag has no gusset. The reclose strip 140, with or without a release liner, is secured to one or both of the inside walls across the side of the package, from end seal 231 to end seal 233.

While the invention has been particularly shown and described with reference to a preferred embodiment, it will be understood by those skilled in the art that various changes in form and detail may be made therein without departing from the spirit and scope of the invention.

What is claimed is:

1. A method for making a flexible reclosable stand-up package on a vertical form, fill, and seal machine, said method comprising the steps of:

a) advancing a continuous sheet of packaging film towards said vertical form, fill, and seal machine;

b) attaching a length of reclose strip to a surface of said advancing sheet of packaging film along the longitudinal axis of said sheet of packaging film;

c) feeding said packaging film into said vertical form, fill, and seal machine;

d) forming said packaging film into a tube on said vertical form, fill, and seal machine and forming a longitudinal seal, wherein said surface of packaging film having said reclose strip attached thereto is situated on the interior of said tube;

e) forming a first traverse seal on said tube;

f) dropping a product into a partially formed package created by steps a) through e);

g) forming a second traverse seal on said tube; and h) severing said package from said tube at said second traverse seal, wherein said reclose strip further comprises a first side having a first peel strength and a second side having a second peel strength, wherein said first and second peel strengths are different.

2. The method of claim 1 wherein said length of reclose strip is continuous.

3. A method for making a flexible reclosable stand-up package on a vertical form, fill, and seal machine, said method comprising the steps of:

a) advancing a continuous sheet of packaging film towards said vertical form, fill, and seal machine;

b) attaching a length of reclose strip to a surface of said advancing sheet of packaging film along the longitudinal axis of said sheet of packaging film;

c) feeding said packaging film into said vertical form, fill, and seal machine;

d) forming said packaging film into a tube on said vertical form, fill, and seal machine and forming a longitudinal seal, wherein said surface of packaging film having said reclose strip attached thereto is situated on the interior of said tube;

e) forming a first traverse seal on said tube;

f) dropping a product into a partially formed package created by steps a) through e);

g) forming a second traverse seal on said tube; and h) severing said package from said tube at said second traverse seal, wherein said reclose strip comprises a release liner.

4. The method of claim 3 wherein said length of reclose strip is continuous.

5. A method for making a flexible reclosable stand-up package on a vertical form, fill, and seal machine, said method comprising the steps of:

a) advancing a continuous sheet of packaging film towards said vertical form, fill, and seal machine;

b) attaching a length of reclose strip to a surface of said advancing sheet of packaging film along the longitudinal axis of said sheet of packaging film;

c) feeding said packaging film into said vertical form, fill, and seal machine;

d) forming said packaging film into a tube on said vertical form, fill, and seal machine and forming a longitudinal seal, wherein said surface of packaging film having said reclose strip attached thereto is situated on the interior of said tube;

e) forming a first traverse seal on said tube;

f) dropping a product into a partially formed package created by steps a) through e);

g) forming a second traverse seal on said tube; and h) severing said package from said tube at said second traverse seal, wherein said machine at step c) comprises a recessed fill tube, such that said reclose strip is aligned with said recessed portion at step d), and further comprising the step of removing a release liner from said reclose strip after step b).

6. The method of claim 5 further comprising the step of adhering inner film walls together with a pinching mechanism prior to step f) of dropping product into said partially formed package.

7. The method of claim 5 wherein said length of reclose strip is continuous.

* * * * *